US005836026A

United States Patent [19]

Reed

[11] Patent Number: 5,836,026

[45] Date of Patent: Nov. 17, 1998

[54] ORTHOPEDIC TRAPEZE WITH SELF-LOCKING ROTATABLE MECHANISM

[76] Inventor: Michael C. Reed, 207 Arbor Ct., Omaha, Nebr. 68108

[21] Appl. No.: 827,990

[22] Filed: May 22, 1997

[51] Int. Cl.[6] ..... A47C 31/00

[52] U.S. Cl. ..... 5/662; 5/503.1; 5/87.1; 5/650

[58] Field of Search ..... 5/662, 658, 503.1, 5/81.1 R, 87.1; 403/385, 391, 396; 248/288.11, 289.11, 291.1

[56] References Cited

U.S. PATENT DOCUMENTS

| | | | |
|---|---|---|---|
| 798,114 | 8/1905 | Rosenthal | 5/658 |
| 2,729,473 | 1/1956 | Warshawsky | 248/289.11 |
| 3,077,603 | 2/1963 | Mayer | 248/289.11 |
| 3,937,451 | 2/1976 | Dipaola et al. | 403/385 |
| 4,443,128 | 4/1984 | Yamamoto et al. | 403/385 |
| 4,747,569 | 5/1988 | Hoshino | 248/291.1 |
| 5,362,021 | 11/1994 | Phillips | 5/658 |

*Primary Examiner*—Kenneth J. Dorner
*Assistant Examiner*—Fredrick Conley
*Attorney, Agent, or Firm*—Rothwell, Figg, Ernst & Kurz

[57] ABSTRACT

An orthopedic trapeze for a hospital bed for use with an overhead frame bar. The orthopedic trapeze includes an upper base assembly mounted on the overhead frame bar, a lower base assembly attached to the upper base assembly. The upper base assembly can slide linearly upon the overhead frame bar, the lower base assembly can rotate 360 degrees in a horizontal plane with respect to the upper base assembly, and the trapeze bar can slide linearly within the lower base assembly, giving the trapeze handle the ability to be positioned anywhere over the hospital bed, including the ability to be positioned past the edges of the bed. In the absence of any external weight on the trapeze handle the lower base assembly and trapeze bar and trapeze handle will rotate freely, while a weight placed on the trapeze handle will lock the lower base assembly in position. A patient can therefore position the trapeze handle at any desired location.

19 Claims, 7 Drawing Sheets

ORTHOPEDIC TRAPEZE WITH SELF-LOCKING ROTATABLE MECHANISM

BACKGROUND OF THE INVENTION

1. Field of the Invention

The present invention relates to an orthopedic trapeze, and more specifically to a new and improved orthopedic trapeze for use with a hospital bed.

2. Description of Prior Art

An orthopedic trapeze is an apparatus used in conjunction with a hospital or similar bed to provide an ill or injured patient with a steady hand grip that can be used when getting into the bed, out of the bed, or changing positions on the bed. The orthopedic trapeze is commonly used by patients recovering from certain types of surgery, such as back surgery.

In the past, orthopedic trapeze design has been relatively simple. The prior art discloses an orthopedic trapeze slidably mounted on an overhead frame bar that runs all or part of the length of a bed. The orthopedic trapeze can usually be moved horizontally along the overhead frame bar. In some instances the overhead frame may be rotated in an arc over the bed. Such an orthopedic trapeze generally can only be adjusted by a person standing beside the bed, and provides only simple adjustment capability.

Several drawbacks exist in the prior art. A first drawback of the prior art is that in the past, orthopedic trapezes were designed to be adjusted by someone other than the patient, such as a nurse or technician. Furthermore, even if a patient desired to adjust the prior art orthopedic trapeze, the prior art orthopedic trapeze generally was not designed for adjustment by the patient or especially by the patient in the bed. A need exists for an orthopedic trapeze that can be easily adjusted by a patient in or out of the bed. A second drawback of the prior art is the limited range of adjustment offered by the prior art orthopedic trapeze. Many prior art approaches are centered over the middle of the bed, and cannot accommodate a need of a patient to pull up from a selected position to either side of the middle. When a patient in a hospital bed needs to sit up, for example, he may need to pull himself upward but not toward the center of the bed. A need exists for an orthopedic trapeze that can be positioned where best suited to the patient's need. A third drawback of the prior art is that prior art orthopedic trapezes were not designed to help a person beside the bed, such as a patient in a wheelchair, get into or out of the wheelchair as part of getting into or out of the bed. A need exists for an orthopedic trapeze that can extend past the boundary of the bed to provide assistance in getting into or out of a wheelchair positioned beside the bed.

What is needed therefore is a new and improved orthopedic trapeze capable of addressing the needs outlined above.

SUMMARY OF THE INVENTION

It is an object of the invention to provide an orthopedic trapeze having a rotatable trapeze that can be locked in a rotational position by a patient when a downward force is placed on the trapeze handle by the patient.

The invention comprises a new and improved orthopedic trapeze for a hospital bed having an overhead frame bar. The orthopedic trapeze comprises an upper base assembly supported by the overhead frame bar, a lower base assembly, a trapeze bar supported by the lower base assembly, and a trapeze handle and chain depending from an end of the trapeze bar. A support means rotatably links the lower base assembly to the upper base assembly while allowing full rotation of the lower base assembly. The trapeze bar, chain and trapeze handle are capable of supporting a patient in the hospital bed, with the trapeze bar and lower base assembly pivoting in a vertical plane when under load. When under load and pivoting downward, the trapeze bar forces a pressure plate upward, compressing together two friction discs, which locks the lower base assembly in a position and prevents rotation. When not under load, a biasing spring prevents the pressure plate from pressing against the friction discs, and the lower base assembly is allowed to freely rotate. In this manner, a patient in the hospital bed may adjust the orthopedic trapeze to a desired rotational position and then lock it in place by pulling down on the trapeze handle.

The present application was developed to provide a convenient, easy to use, and reliable orthopedic trapeze for persons who need assistance in getting into and out of a hospital bed. The present application has incorporated several important and useful features. First, the trapeze bar and trapeze assembly are capable of rotating continuously through 360 degrees of travel. Second, the center of rotation can be moved anywhere along the overhead frame bar, from the head of the bed to the foot of the bed. Third, the radius of rotation of the trapeze can be adjusted, allowing the trapeze to extend out past the edge of the bed and be positioned over a wheel chair or gurney. Fourth, the patient can control the rotational position of the trapeze, and will not need the assistance of a nurse or technician to place the trapeze in a convenient location. Fifth, the patient can move the trapeze while laying in the bed. Sixth, the trapeze can be locked into a fixed position so that a patient can put weight on the trapeze without fear of the trapeze suddenly moving. The more weight a patient places on the trapeze, the more firmly it will be held in position. Seventh, the locking mechanism does not require physical strength as in a hand tightened screw.

DETAILED DESCRIPTION OF THE PREFERRED EMBODIMENTS

Figure 1:
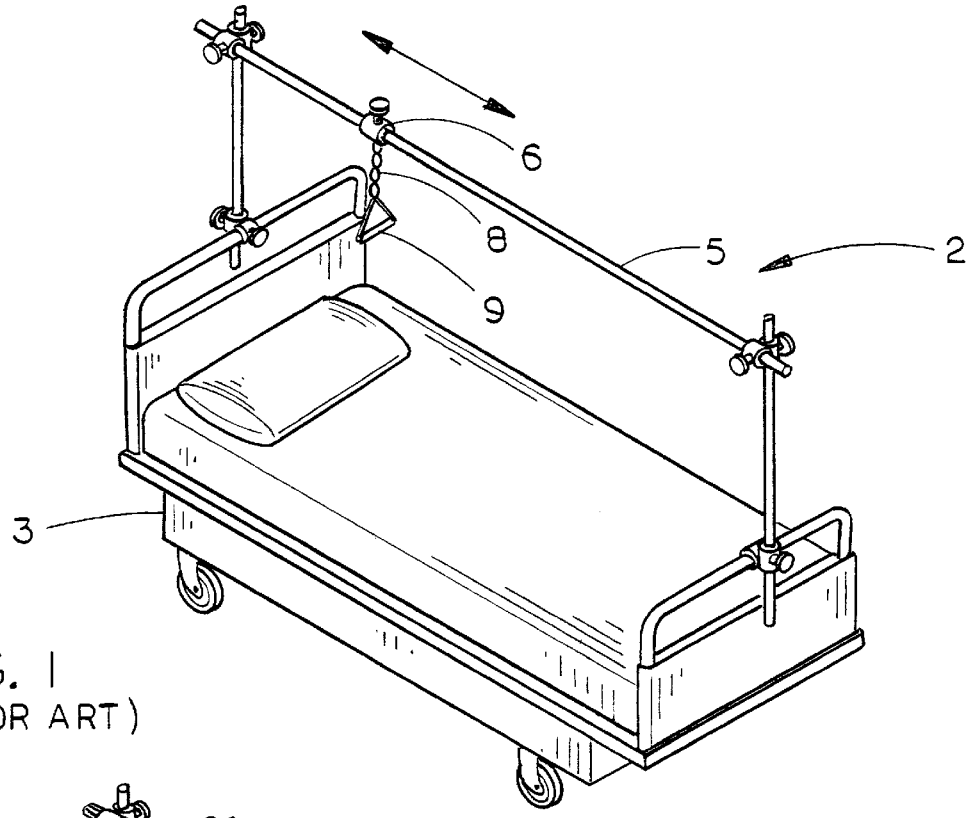
FIG. 1 (PRIOR ART)
FIG. 1 shows an orthopedic trapeze of the prior art.

Referring now to FIG. 1, there is shown in isometric form a prior art orthopedic trapeze 2. The prior art orthopedic trapeze 2 includes an overhead frame bar 5, a cuff 6, a chain 8, and a trapeze handle 9, with the overhead frame bar 5 being attached to a bed 3. The trapeze handle 9 is attached to the chain 8, which is in turn attached to the cuff 6, with the cuff 6 being supported by the overhead frame bar 5. The cuff 6 is capable of linear movement along the overhead frame bar 5. In use, a person in the bed 3 can use the trapeze handle 9 for support and assistance in getting into and out of the bed 3, but must lift himself toward the center of the bed, where the overhead frame bar 5 is generally positioned.

Figure 2:
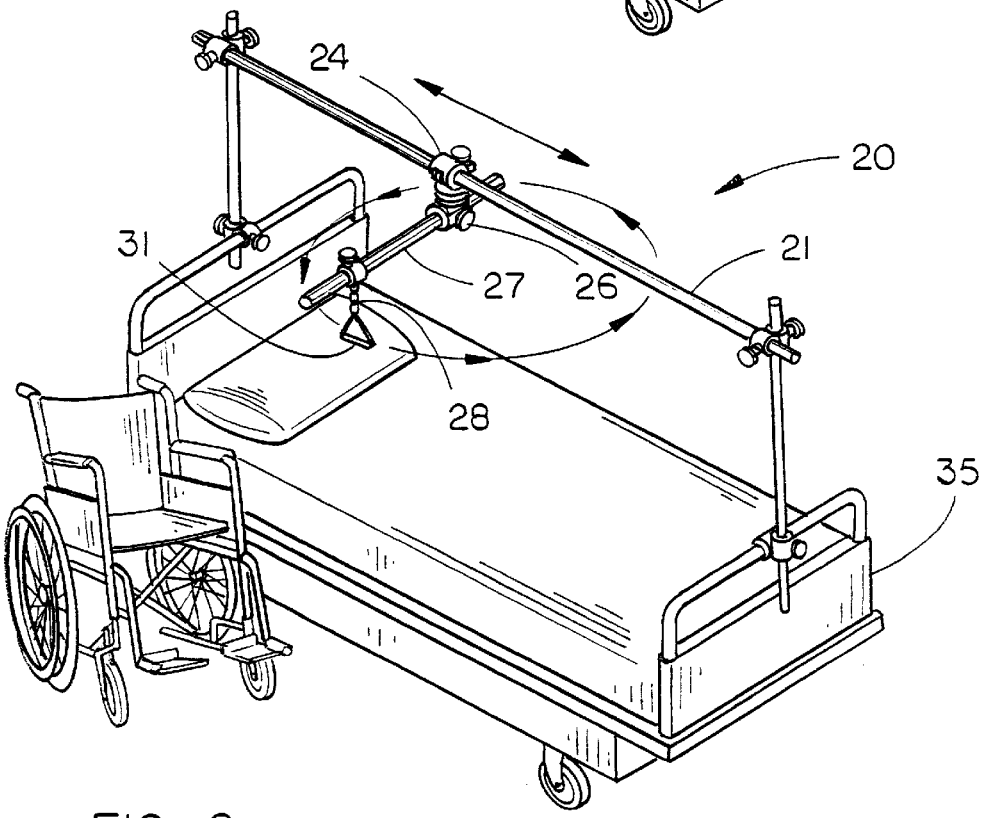
FIG. 2 shows an embodiment of an orthopedic trapeze of the present invention.

Referring now to FIG. 2, there is shown in isometric form an embodiment of the orthopedic trapeze 20 of the present invention. The orthopedic trapeze 20 includes an overhead frame bar 21, an upper base assembly 24, a lower base assembly 26, a trapeze bar 27, a chain 28, and a trapeze handle 31, with the overhead frame bar 21 being attached to a bed 35. The upper base assembly 24 is supported by the overhead frame bar 21, and is capable of linear movement along the overhead frame bar 21. The lower base assembly 26 is rotatably attached to the upper base assembly 24, and can rotate 360 degrees with respect to the upper base assembly 24. The trapeze bar 27 is capable of sliding linearly within the lower base assembly 26.

Figure 3:
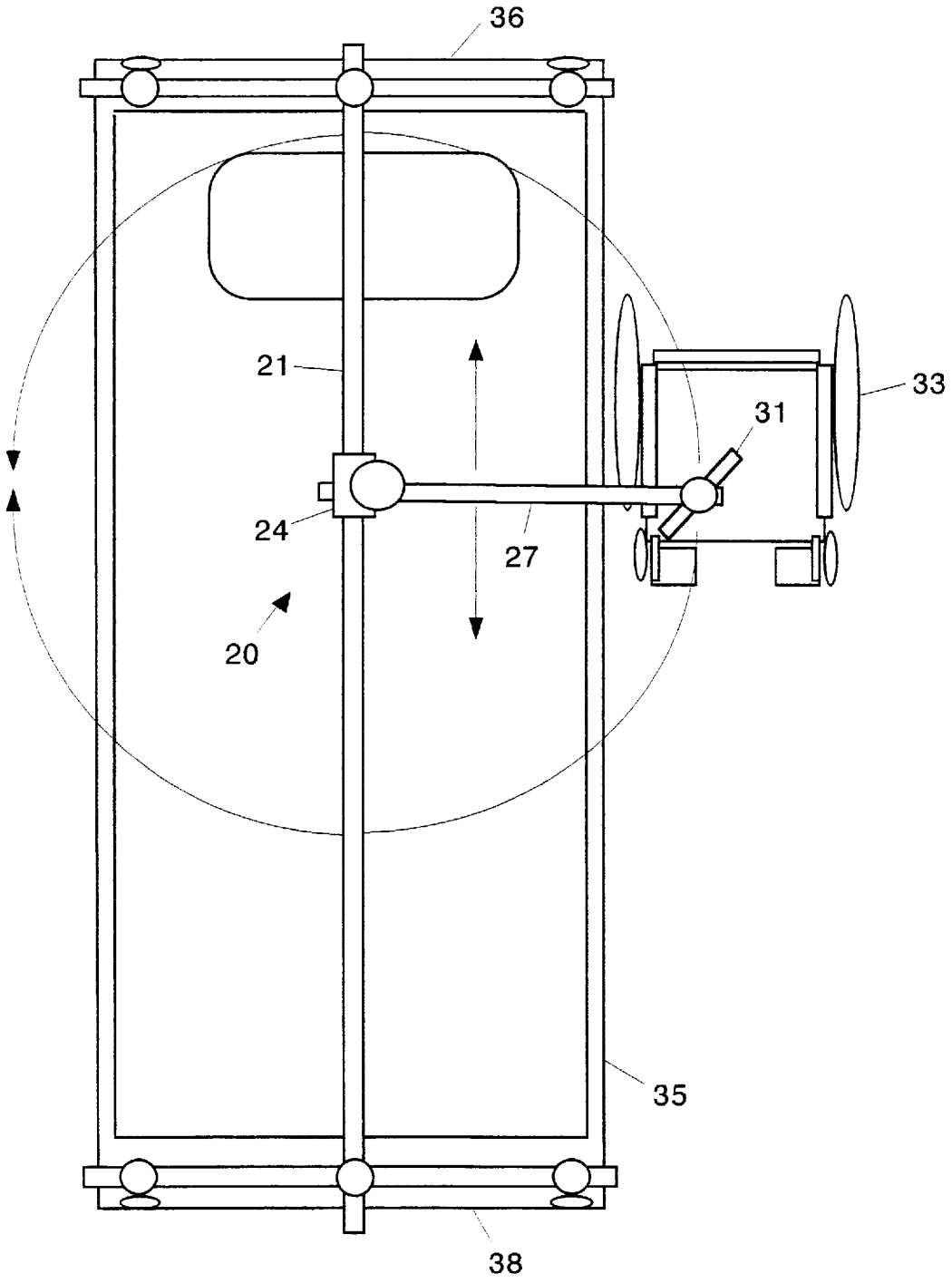
FIG. 3 shows an overhead view of an embodiment of the present invention.

FIG. 3 is an overhead view of one embodiment of the orthopedic trapeze 20, showing a maximum extension of the trapeze bar 27 of the embodiment. Because an end of the trapeze bar 27 can be extended from the orthopedic trapeze 20, the orthopedic trapeze 20 is capable of extending the trapeze handle 31 out past the edge of the bed 35. This is advantageous when a wheelchair-bound person needs assistance getting into or out of a wheelchair 33. Because the upper base assembly 24 can be positioned anywhere on the overhead frame bar 21, the range of movement of the trapeze handle 31 can also extend past a head 36 or a foot 38 of the bed 35.

Figure 4:
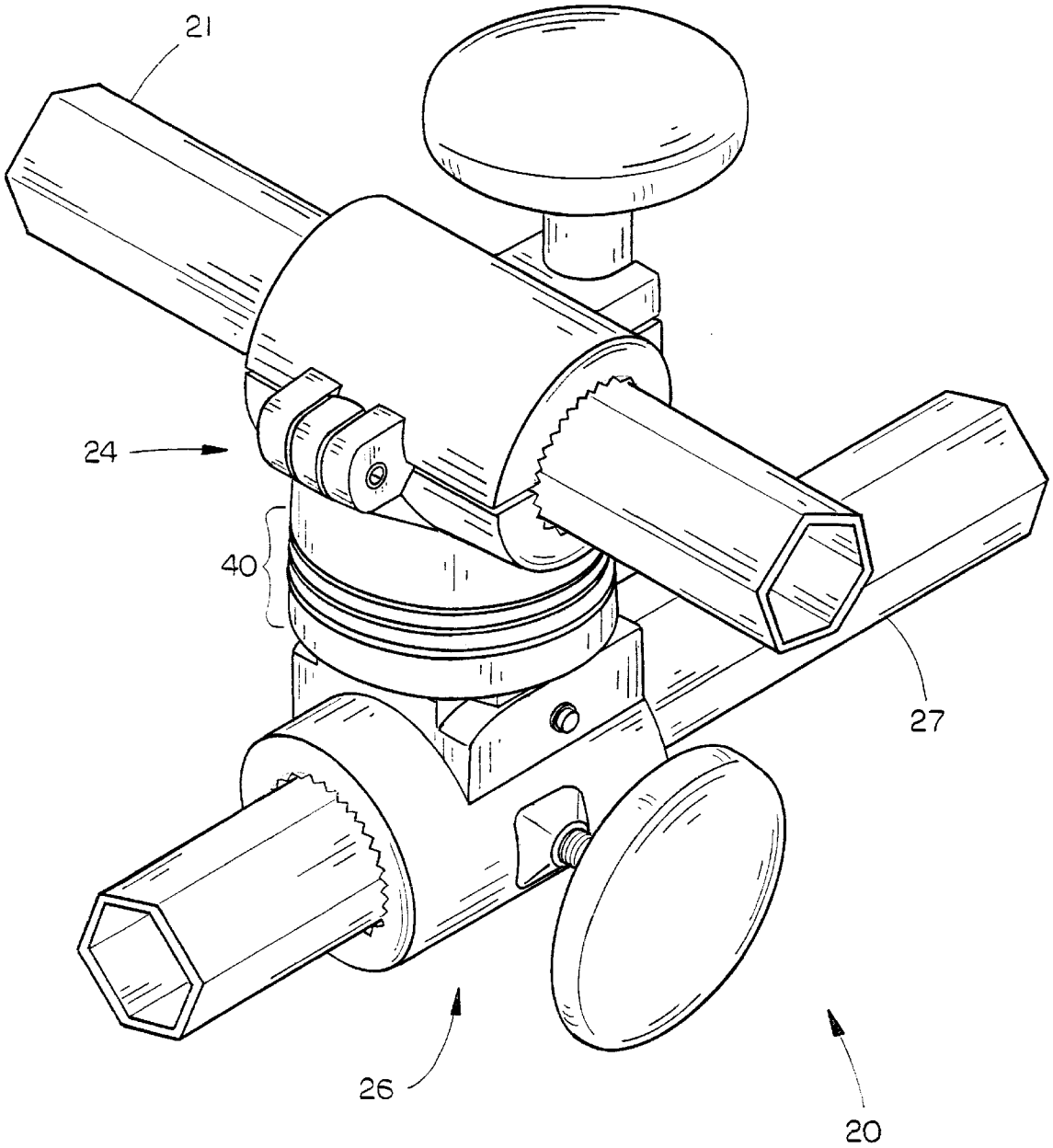
FIG. 4 is an isometric view of the present invention.

FIG. 4 is an isometric view showing the orthopedic trapeze 20 in greater detail. In addition to the previously recited elements, there is shown a clutch means 40 interposed between the upper base assembly 24 and the lower base assembly 26. The clutch means 40 functions to stop rotation of the lower base assembly 26 with respect to the upper base assembly 24 when an external weight acts on the trapeze bar 27. In use, the clutch means 40 allows the lower base assembly 26 to rotate freely in the absence of an external weight above a threshold level further described below, yet locks the lower base assembly 26 in its current position when a weight acts on the trapeze bar 27.

Figure 5:
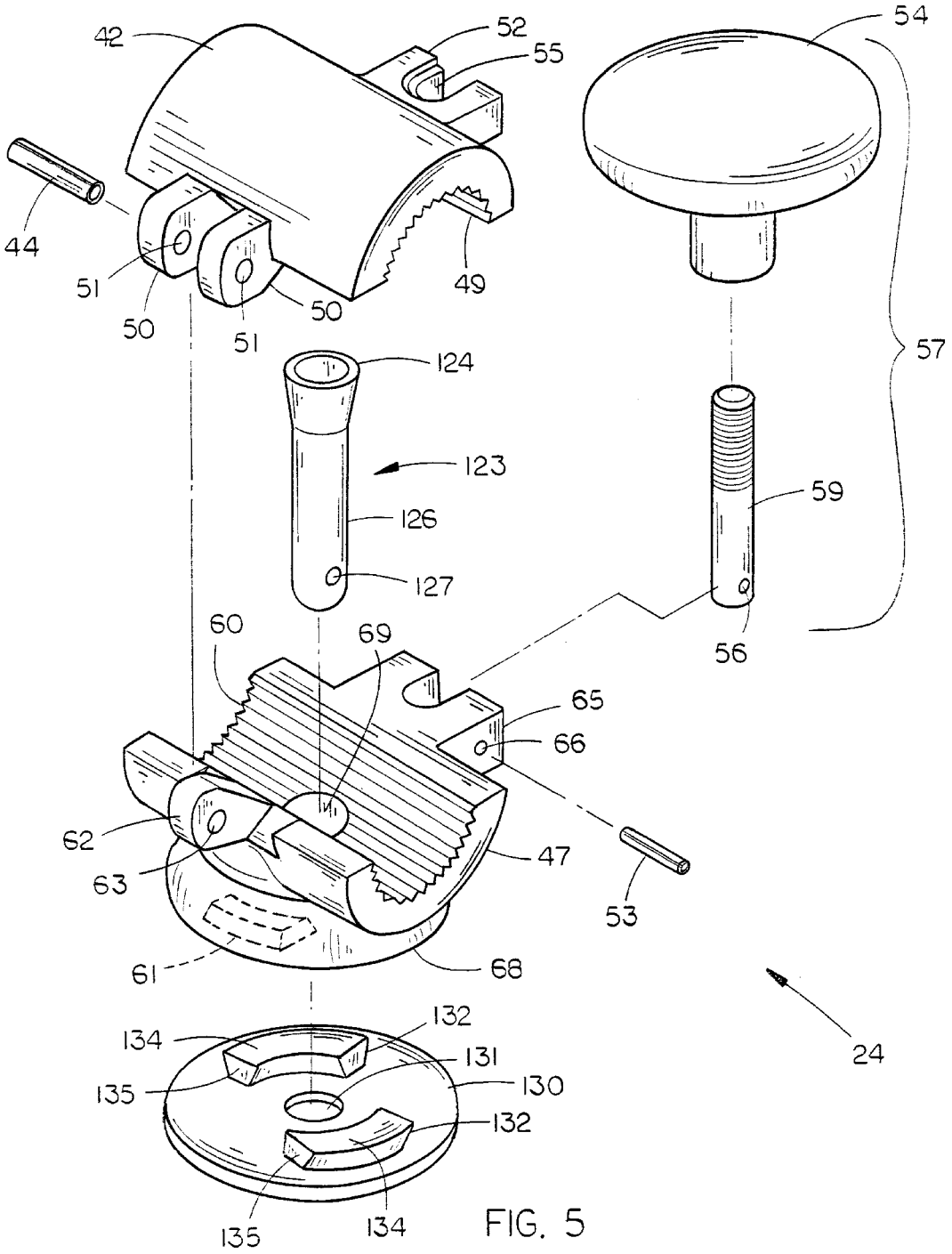
FIG. 5 is an exploded view of the upper base assembly.

FIG. 5 is an exploded view of an embodiment of the upper base assembly 24. The upper base assembly 24 includes an upper half 42, a hinge pin 44, a lower half 47, a rotation pin 123, and an upper friction disc 130. The upper half 42 further includes an upper semicircular trough 49 having a serrated inner surface, a pair of upper ears 50 having holes 51, an upper tab 52 having a slot 55, and a substantially vertical fastener means 57 having a hand knob 54, and a threaded shaft 59 having a hole 56. All directions as to substantially horizontal or substantially vertical are relative to the other components, and are not absolute. The lower half 47 further includes a lower semicircular trough 60 having a serrated inner surface, two locking depressions 61, a lower ear 62 having a hole 63, a lower tab 65 having a slot 66, a planar lower surface 68, and a rotation pin hole 69 passing vertically through the center of the lower half 47.

The preferred embodiment of the rotation pin 123 comprises a tapered head 124, a shaft 126, and a pivot pin hole 127. It should be obvious to one skilled in the art that other shapes could be employed to provide a rotatable support means between the upper base assembly 24 and the lower base assembly 26.

The upper friction disc 130 of a preferred embodiment comprises a center hole 131 for receiving the rotation pin 123, and a detent means for interlocking the upper friction disc 130 with the lower half 47 of the upper base assembly 24. In a preferred embodiment, the detent means comprises a pair of locking ribs 132. The locking ribs 132 have a top surface 134 and side walls 135, with the side walls 135 sloping outwardly, making the locking ribs 132 larger at the top surface 134. The pair of locking ribs 132 are capable of fitting tightly within the pair of locking depressions 61 in the lower half 47 of the upper base assembly 24. In a preferred embodiment, the friction disc 130 is composed of a rubber material, although it will be apparent to one skilled in the art that other materials having a suitable coefficient of friction could be substituted.

When assembled to form the upper base assembly 24, the upper half 42 and the lower half 47 hinge on the hinge pin 44, of which a portion resides in the upper ears 50 and a portion resides in the lower ear 62, allowing the upper half 42 and the lower half 47 to open in a clamshell fashion. The fastener means 57 can be extended through the upper tab 52, and is pivotally attached to the lower half 47 by the hinge pin 53, residing partially in the hole 66 of the lower tab 65 and partially in the hole 56 of the threaded shaft 59. The fastener means 57 functions to fasten the upper half 42 and the lower half 47. The overhead frame bar 21 is received by the substantially cylindrical passage formed by the upper semicircular trough 49 and the lower semicircular trough 60. It should be noted that the upper semicircular trough 49 and the lower semicircular trough 60 do not have to form a perfectly cylindrical passage. The overhead frame bar 21 is held in a relatively fixed position with respect to the upper base assembly 24 when the fastener means 57 applies a tension between the upper tab 52 and the lower tab 65, clamping the overhead frame bar 21 in the serrated surface of the substantially cylindrical passage formed by the upper semicircular trough 49 and the lower semicircular trough 60.

Figure 6:
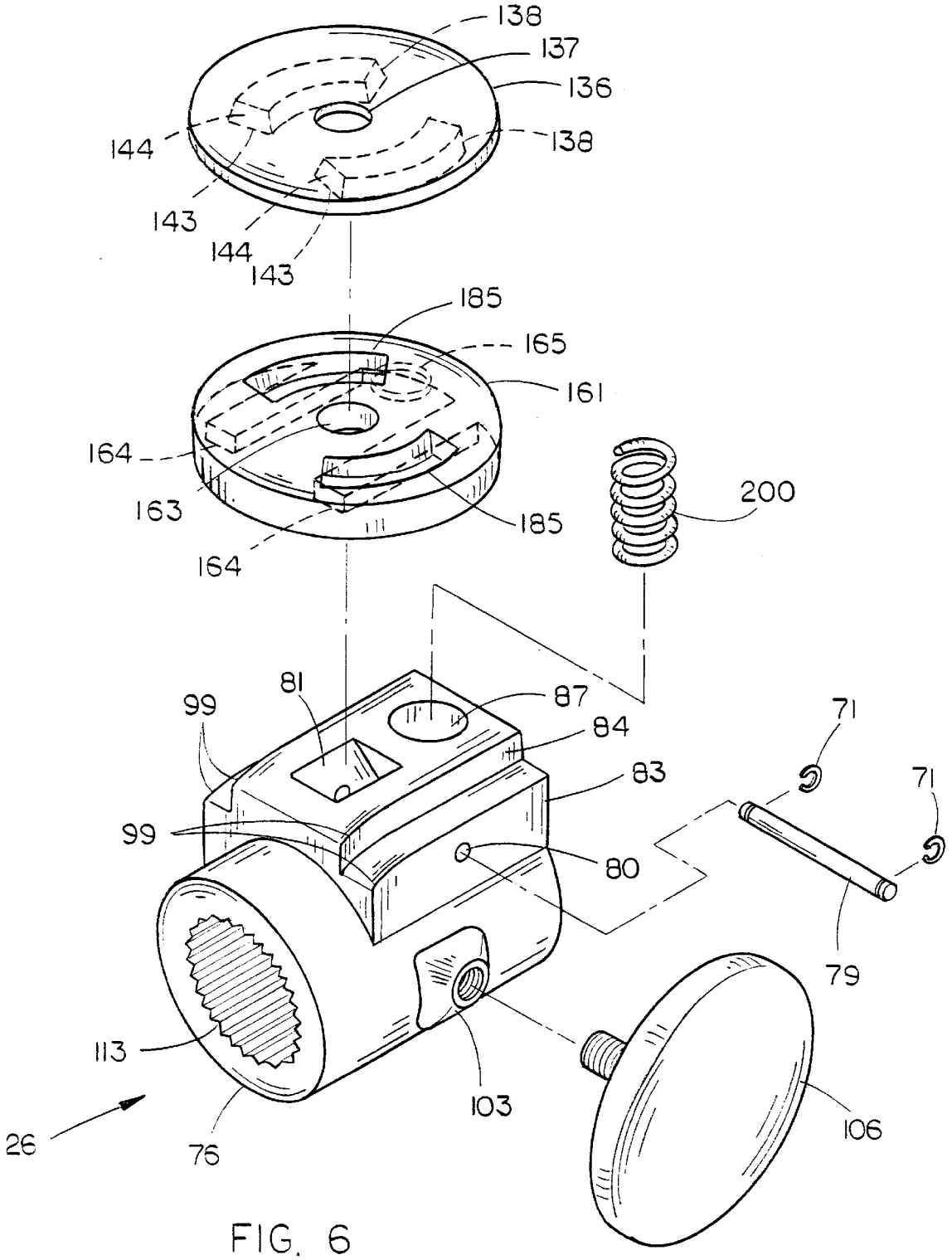
FIG. 6 is an exploded view of the lower base assembly.

FIG. 6 is an exploded view of an embodiment of the lower base assembly 26. The lower base assembly 26 includes a lower friction disc 136, a pressure plate 161, a spring 200, a pivot pin 79, a pair of retainers 71, a hand knob 106, and a lower base 76. The lower base 76 further includes a cylindrical passage 113 having a serrated interior surface, a pivot pin hole 80 passing through the lower base 76, a circular depression 87, a hole 81, a threaded hole 103, a rectangular upper body 83 having a step 84, and a plurality of rounded front edges 99.

When assembled to form the lower base assembly 26, the rotation pin 123 extends through the hole 137 in the friction disc 136, through the hole 163 in the pressure plate 161, and into the hole 81 of the lower base 76, where it is pivotally retained by the pivot pin 79. The pivot pin 79 passes through the hole 80 in the lower base 76 while passing through the hole 127 of the rotation pin 123, and is held in place in the lower base 76 by the retainers 71 clipped over the ends of the pivot pin 79. The spring 200 extends between the circular depression 165 in the pressure plate 161 and the circular depression 87 in the lower base 76. The trapeze bar 27 is received by the circular passage 113, and the trapeze bar 27 is prevented from moving within the circular passage 113 by the extension of the hand knob 106 through the threaded hole 103

The lower friction disc 136 of a preferred embodiment is identical to the upper friction disc 130, comprising a center hole 137 for receiving the rotation pin 123, and a detent means for interlocking the lower friction disc 136 with the pressure plate 161. In a preferred embodiment, the detent means comprises a pair of locking ribs 138. The pair of locking ribs 138 have a top surface 143 and side walls 144, with the side walls 144 sloping outwardly, making the locking ribs 138 larger at the top surface 143. The pair of locking ribs 138 are capable of fitting tightly within the pair of locking depressions 185 in the pressure plate 161.

The preferred embodiment of the pressure plate 161 has a center hole 163 for receiving the rotation pin 123, a circular spring depression 165, a pair of locking depressions 185, and a pair of ribs 164. The circular spring depression 165 is formed to receive and hold one end of the spring 200. The pair of ribs 164 are evenly displaced on either side of the center hole 163, and extend from one edge of the pressure plate 161 to a predetermined point short of the opposite edge of the pressure plate 161. The shape and placement of the pair of ribs 164 could be altered without changing their function. The pair of ribs 164 act as pivot guides when the lower base 76 pivots in a vertical plane with respect to the pressure plate 161. The pair of ribs 164 are stationed on either side of the top surface of the lower base 76, and act as guides to keep the pressure plate 161 from rotating with respect to the lower base 76.

The locking ribs 138 of the lower friction disc 136 are capable of fitting tightly within the pair of locking depressions 185.

Figure 7:
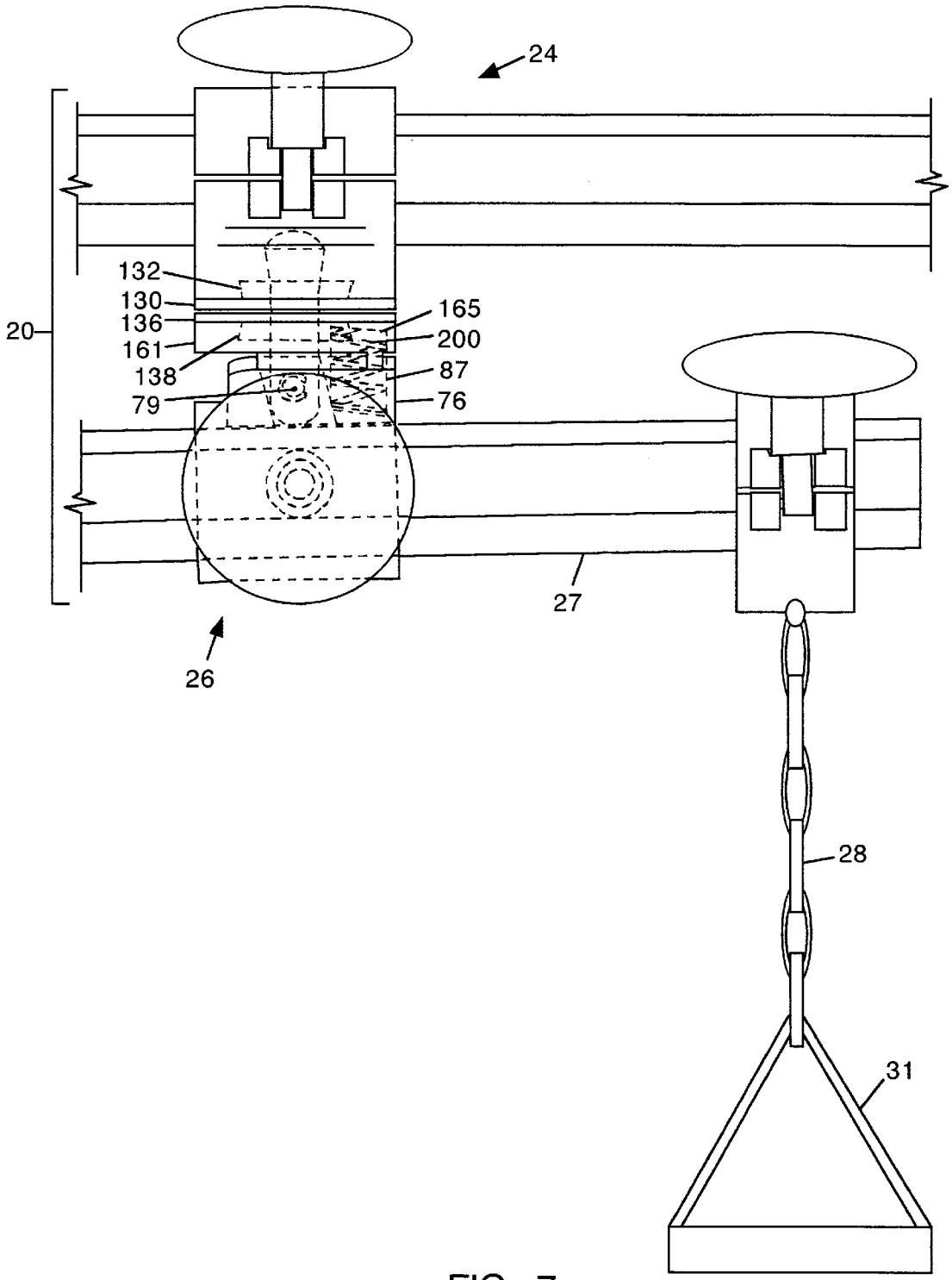
FIG. 7 shows the unloaded orthopedic trapeze.

FIG. 7 demonstrates the unloaded, freely rotating configuration of the orthopedic trapeze 20. At rest, meaning no external load is acting on the trapeze bar 27, a biasing means counteracts the weight of the trapeze bar 27, the chain 28, and the trapeze handle 31 by pulling the pressure plate 161 and the lower base 76 together. In the preferred embodiment, the biasing means comprises the helical spring 200. The helical spring 200 is received and held in place by the circular depression 165 in the pressure plate 161 and the corresponding circular depression 87 in the lower base 76. The rotation pin 123 rests in the rotation pin hole 69 with the shaft 126 extending into the lower base 76, and being held in place by the pivot pin 79. The upper friction disc 130, the lower friction disc 136, and the pressure plate 161 are positioned between the upper base assembly 24 and the lower base assembly 26, and are held in position by the rotation pin 123. The upper friction disc 130 is prevented from rotating with respect to the upper base assembly 24 by means of the locking ribs 132 fitting into and being held by the pair of locking depressions 61 in the upper base assembly. The lower friction disc 136 is prevented from rotating with respect to the pressure plate 161 by means of the locking ribs 138 fitting into and being held by the pair of locking depressions 185 in the pressure plate 161.

Figure 8:
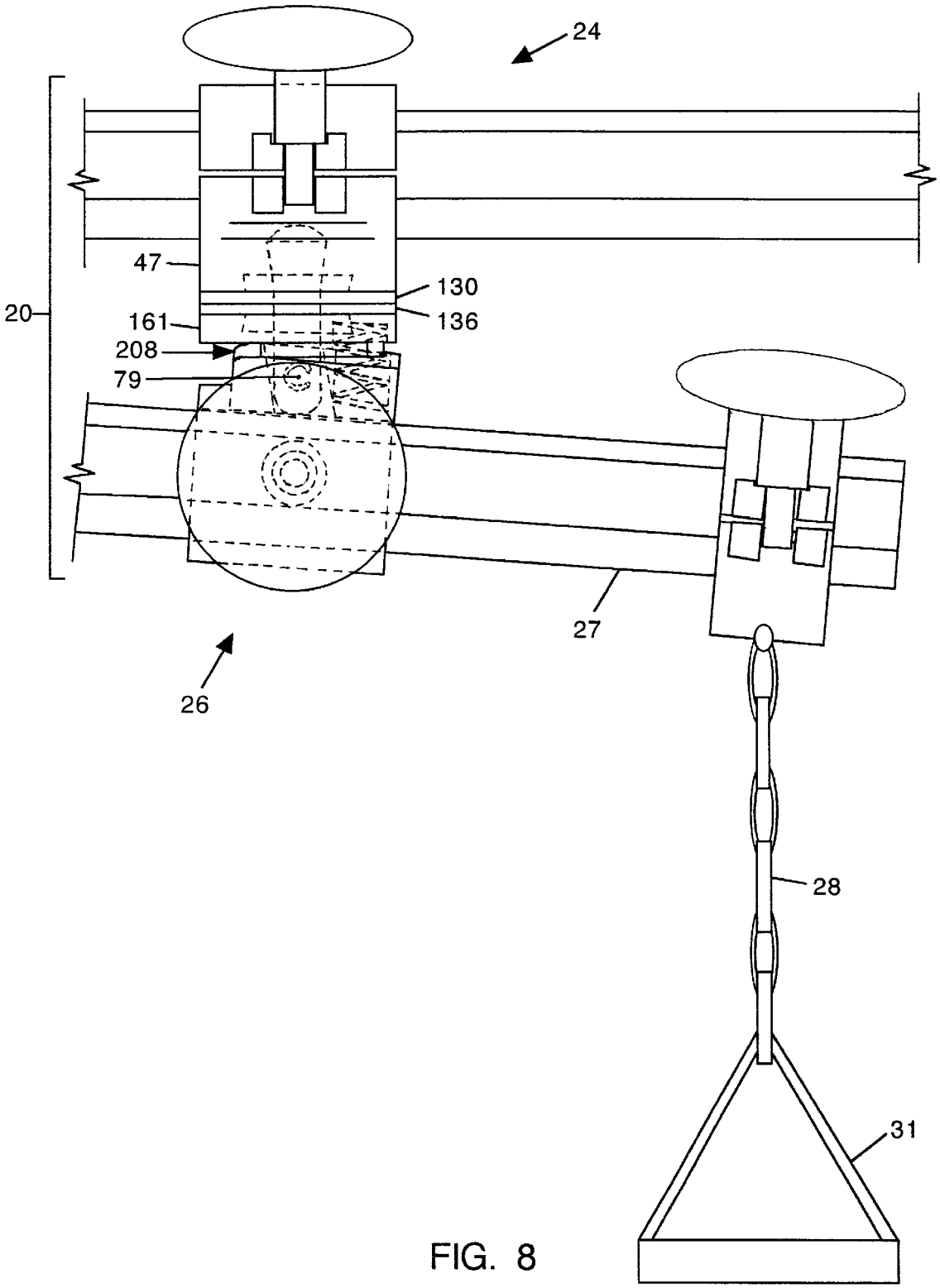
FIG. 8 shows the orthopedic trapeze under a load.

FIG. 8 is an elevation that shows the orthopedic trapeze 20 when an external weight is placed on the trapeze bar 27 via the chain 28 and the trapeze handle 31. The lower base assembly 26 pivots around the pivot pin 79, with the rising corner 208 of the lower base assembly 26 forcing the pressure plate 161 upward, which in turn compresses the lower friction disc 136 and the upper friction disc 130 against the lower half 47 of the upper base assembly 24. The compression of the lower friction disc 136 and the upper friction disc 130 increases the friction between the two until the lower base assembly 26 cannot rotate with respect to the upper base assembly 24.

While the invention has been disclosed in detail above, the invention is not intended to be limited strictly to the invention as disclosed. It is evident that those skilled in the art may now make numerous uses and modifications of and departures from the specific embodiments described herein without departing from the inventive concepts.

I claim:

1. An orthopedic trapeze for a hospital bed with respect to which an overhead frame bar is positioned, including:

an upper base assembly capable of travel along the overhead frame bar;

a lower base assembly;

support means for rotatably supporting said lower base assembly for rotation with respect to said upper base assembly, said support means allowing rotation in a horizontal plane;

a trapeze bar supported to said lower base assembly;

a trapeze assembly including a handle attached to said trapeze bar;

engaging means for fixing said trapeze bar at a selectable horizontal position in relation to said lower base assembly for positioning of said handle;

pivot means for pivotally attaching said lower base assembly to said support means, said pivot means depending from said support means and allowing pivotal movement in a vertical plane;

clutch means for engaging said lower base assembly against said upper base assembly to prevent rotation, said rotation pin passing through a center hole, said clutch means being activated in response to an external force on said trapeze assembly and said trapeze bar, said external force causing said trapeze bar and said lower base assembly to pivot, causing the clutch means to be moved upward and become engaged with said upper base assembly; and biasing means between said clutch means and said lower base assembly for counteracting a gravitational force from said trapeze bar and said trapeze assembly, said biasing means preventing said trapeze bar from pushing said clutch means upward to contact said upper base assembly, thereby disengaging said clutch means when said external force is absent from said trapeze bar and said trapeze assembly.

2. The orthopedic trapeze of claim 1, wherein said biasing means is concentric about the center of said clutch means.

3. The orthopedic trapeze of claim 1, wherein said biasing means is offset from said rotation pin and provides a force in opposition to said external force provided by said bar and said trapeze assembly.

4. The orthopedic trapeze of claim 1, wherein said biasing means is a spring.

5. An orthopedic trapeze for a hospital bed having an overhead frame bar, including:

an upper base assembly capable of travel along the overhead frame bar;

a lower base assembly having a hollow channel for receiving a rotation pin;

a trapeze bar supported to said lower base assembly;

a trapeze assembly including a handle attached to said trapeze bar;

engaging means for fixing said upper base assembly at a selected position on the overhead frame bar;

engaging means for fixing said trapeze bar at a selected horizontal position in relation to said lower base assembly;

a rotation pin for rotatably linking said upper base assembly to said lower base assembly, with an upper portion passing through said upper base assembly and a lower portion entering said hollow channel in said lower base assembly, with said upper portion of said rotation pin free to rotate with respect to said upper base assembly;

a pivot pin extending horizontally through said lower base assembly and said rotation pin, with said pivot pin allowing said lower base assembly to pivot in a vertical plane;

a pressure plate positioned between said upper base assembly and said lower base assembly, and having said rotation pin passing through a center hole, and capable of upward movement toward a lower face of said upper base assembly, said upward movement occurring when an external force is applied in a downward direction to said handle of said trapeze assembly, forcing said lower assembly to pivot, pushing said pressure plate upward;

a biasing device positioned between said pressure plate and said lower base assembly to provide a force between said pressure plate and said lower base assembly to counteract a gravitational force from said trapeze bar and trapeze assembly; and a friction disc means positioned between said upper base assembly and said pressure plate, with said rotation pin passing through a center hole, said friction disc functions to prevent relative rotation of said pressure plate and said lower base assembly when said friction disc is compressed between said pressure plate and said upper base assembly by an upward motion of said pressure plate.

6. The orthopedic trapeze of claim 5 further including a pivot guide means comprising at least one rib formed on a lower surface of said pressure plate and spaced parallel and contiguous to a top edge of said lower base assembly.

7. The orthopedic trapeze of claim 5 wherein said biasing device is a spring.

8. The orthopedic trapeze of claim 5 wherein said biasing device is concentric about said rotation pin.

9. The orthopedic trapeze of claim 5 wherein said biasing device is offset from said rotation pin.

10. The orthopedic trapeze of claim 5 wherein said friction disc means is made of rubber.

11. The orthopedic trapeze of claim 5 wherein said friction disc means further includes detent means for interlocking an adjacent element, namely said upper base assembly or said pressure plate.

12. The orthopedic trapeze of claim 5 wherein said hollow channel in said lower base assembly limits a vertical pivotal travel of said lower base assembly.

13. The orthopedic trapeze of claim 5 wherein said friction disc means includes an upper rubber disc having a detent means for interlocking with said upper base assembly, with said rotation pin passing through a center hole, and a lower rubber disc having a detent means for interlocking with said pressure plate, with said rotation pin passing through a center hole, said upper rubber disc and said lower rubber disc function to prevent relative rotation of said pressure plate and said lower base assembly when said upper rubber disc and said lower rubber disc are brought into contact by an upward motion of said pressure plate.

14. An orthopedic trapeze for a hospital bed having an overhead frame bar, including:

an upper base assembly capable of travel along the overhead frame bar;

a lower base assembly having a hollow channel for receiving a rotation pin;

a trapeze bar supported to said lower base assembly;

a trapeze assembly including a handle attached to said trapeze bar;

engaging means for fixing said upper base assembly at any position on the overhead frame bar;

engaging means for fixing said trapeze assembly at any horizontal position in relation to said lower base assembly;

a rotation pin for rotatably linking said upper base assembly to said lower base assembly, with an upper portion passing through said upper base assembly and a lower portion entering said hollow channel in said lower base assembly, with said upper portion of said rotation pin free to rotate with respect to said upper base assembly;

a pivot pin extending horizontally through said lower base assembly and said rotation pin, with said pivot pin allowing said lower base assembly to pivot in a vertical plane;

a pressure plate positioned between said upper base assembly and said lower base assembly, and having said rotation pin passing through a center hole, said pressure plate functions to rotationally fix said pressure plate and said lower base assembly when said pressure plate is moved upward into contact with a lower face of said upper base assembly; and a biasing device positioned between said pressure plate and said lower base assembly to counteract a gravitational force from said trapeze bar and trapeze assembly.

15. The orthopedic trapeze of claim 14 wherein said hollow channel in said lower base assembly limits a vertical pivotal travel of said lower base assembly.

16. The orthopedic trapeze of claim 14 further including a pivot guide means comprising at least one rib formed on a lower surface of said pressure plate and spaced parallel and contiguous to a top edge of said lower base assembly.

17. The orthopedic trapeze of claim 14 wherein said biasing device is a spring.

18. The orthopedic trapeze of claim 14 wherein said biasing device is concentric about said rotation pin.

19. The orthopedic trapeze of claim 14 wherein said biasing device is offset from said rotation pin.

* * * * *